US005246122A

United States Patent [19]

Schick et al.

[11] Patent Number: 5,246,122

[45] Date of Patent: Sep. 21, 1993

[54] COLLAPSIBLE STORAGE BOTTLE FOR HOUSEHOLD LIQUIDS

[75] Inventors: Jürgen Schick, Hemsbach; Volker Reimann-Dubbers, Heidelberg, both of Fed. Rep. of Germany

[73] Assignee: Joh. A. Benckiser GmbH, Ludwigshafen, Fed. Rep. of Germany

[21] Appl. No.: 689,274

[22] PCT Filed: Dec. 22, 1989

[86] PCT No.: PCT/EP89/01597

§ 371 Date: Jun. 13, 1991

§ 102(e) Date: Jun. 13, 1991

[87] PCT Pub. No.: WO90/07453

PCT Pub. Date: Jul. 12, 1990

[30] Foreign Application Priority Data

Dec. 28, 1988 [DE] Fed. Rep. of Germany ..... 3844090

[51] Int. Cl.[5] ..... B65D 1/02; B65D 23/00; B65D 23/10

[52] U.S. Cl. ..... 215/1 C; 215/12.2; 220/608; 220/666; 220/623

[58] Field of Search ..... 215/1 C, 100 A, 12.2; 383/104, 116; 222/105, 107, 215; 220/608, 609, 666, 667, 623, 624

[56] References Cited

U.S. PATENT DOCUMENTS

| | | | |
|---|---|---|---|
| 2,208,744 | 7/1940 | Bergerioux | 220/624 X |
| 3,077,295 | 2/1963 | Whiteford | 383/104 X |
| 3,081,002 | 3/1963 | Tauschinski et al. | 222/105 |
| 3,106,441 | 10/1963 | Harrison et al. | 215/1 C |
| 3,202,324 | 8/1965 | Honnet et al. | 222/105 X |
| 3,434,652 | 3/1969 | Shore | 303/104 |
| 3,592,360 | 7/1971 | Aleck | 222/107 X |
| 3,604,491 | 9/1971 | Spiess | 383/104 X |
| 3,878,977 | 4/1975 | Carlisle | 222/107 X |
| 3,946,905 | 3/1976 | Cogliano | 222/107 |
| 3,993,222 | 11/1976 | Briggs | 222/107 |
| 4,100,953 | 7/1978 | Miller | 222/107 |
| 4,134,510 | 1/1979 | Chang | 220/608 X |
| 4,174,782 | 11/1979 | Obsomer | 220/608 X |
| 4,244,409 | 6/1981 | Wilson et al. | 222/107 |
| 4,256,231 | 3/1981 | Cioc et al. | 215/1 C |
| 4,320,789 | 3/1982 | Martin et al. | 222/107 |
| 4,662,528 | 5/1987 | Slat | 215/12.2 |
| 4,802,295 | 2/1989 | Darr | 215/122 X |
| 4,837,849 | 6/1989 | Erickson et al. | 383/109 |
| 4,890,757 | 1/1990 | Robbins, III | 383/104 X |
| 4,898,306 | 2/1990 | Pardes | 222/215 X |
| 4,898,477 | 2/1990 | Cox et al. | 383/104 X |
| 4,978,232 | 12/1990 | Dunton | 383/104 X |
| 4,984,712 | 1/1991 | Jouillat | 222/107 X |
| 5,037,002 | 8/1991 | Tschanen | 220/666 X |
| 5,048,977 | 9/1991 | Robbins, III | 383/104 |
| 5,054,631 | 10/1991 | Robbins, III | 220/666 X |
| 5,080,260 | 1/1992 | During | 222/107 |

FOREIGN PATENT DOCUMENTS

| | | | |
|---|---|---|---|
| 0194081 | 9/1986 | European Pat. Off. . | |
| 1385639 | 12/1964 | France . | |
| 2288445 | 5/1976 | France . | |
| 2398671 | 2/1979 | France . | |
| 2417440 | 10/1979 | France | 383/104 |
| 1349294 | 4/1974 | United Kingdom | 222/215 |

*Primary Examiner*—Sue A. Weaver
*Attorney, Agent, or Firm*—Foley & Lardner

[57] ABSTRACT

A storage a pair of outer surfaces, a flexible corrugated bottom surface, a head end having a closeable filling opening, and horizontal standing edges which connect the outer surfaces to the bottom surface. The storage bottle is made from synthetic material and is stable in an unfilled state, and the bottom surface conforms to a surface upon which it is placed.

8 Claims, 2 Drawing Sheets

COLLAPSIBLE STORAGE BOTTLE FOR HOUSEHOLD LIQUIDS

The present invention concerns a storage bottle for household liquids, especially as packing for washing agent solutions and other household chemicals.

Household liquids, such as rinsing agents, washing agents, but also nutrients, such as e.g. oil and vinegar, are marketed in bottles of synthetic material. These represent a problem in the case of waste disposal.

These bottles are relatively rigid, i.e. in the case of disposal, they retain their volume and thus give rise to high spatial requirement in the household, in removal, in recycling or in the waste dump.

Therefore, for washing and rinsing agent solutions, it has already been suggested to provide flat-lying bags with a closable filling tube welded on vertically thereto and with a double bottom edge on each packing half between which, in filled condition, lies a separate inserted bottom and the halves press apart in order thus to make standing possible. Because of the closure standing vertically to the side surface, these bags are difficult to handle or difficult to fill and are relatively expensive in the production.

Therefore, the present invention has set itself the task of providing a storage bottle for the above-mentioned purposes which is able to stand, can be filled from above and, after emptying, can be pressed together without trouble to give a flat body almost freed of air.

The solution of this task succeeds in the case of a storage bottle of preferably extruded synthetic material with the help of the following constructional features a) the bottle has an ellipsoid cross-section with two outer surfaces, as well as a bottom,
b) at the head end, a closable filling opening is formed on the bottle,
c) as transition between the outer surfaces and the bottom, the bottle has horizontal standing edges,
d) the synthetic material is so chosen that the bottle is inherently stable in unfilled state due to its conformation but the bottom is flexible.

For the production, a synthetic material tube is first extruded in per se known manner and closed below. Thereafter, it is enclosed by the mould halves and placed under pressure against their inner wall. The mould halves have a spatial shape corresponding to the above-mentioned features.

Due to the choice of the ellipsoid cross-section, an inherently stable bottle results with a soft, unstable bottom which projects inwardly from the circumferential bottom standing edge corresponding to the two halves. In the case of filling, the bottom hangs downwardly just as in the case of the lifting up of a filled bottle. In the case of placing on a (flat) substrate, the bulging bottom presses without problems into the elastic bottle interior, a corresponding air reserve possibly being left herefor over the liquid.

After the emptying, the ellipsoid halves can, with expulsion of the air present in the bottle, be laid on one another almost without force and, in the case of disposal, essentially require only the spatial content of two films laid upon one another.

In order further to simplify the folding, it is suggested to provide a fold beading, extending to the bottom region at least on one outer surface distanced parallel to the edges or on the edge region between the two outer surfaces, which also stabilises at the same time the retracted ellipsoid concavedly-domed outer surface, i.e. prevents an undesired rebounding, since this engages with the previously mentioned edge.

As indicated above, the bottom is to be softly limp. In order also to ensure such a material property in the case of more rigid material, it is suggested to make this corrugated.

For the present purpose, synthetic materials have proved to be useful, such as tear-resistant polyethylene, polypropylene or the like materials suitable for recycling. These are extruded with tube wall thicknesses between 40–50 $\mu$ and stretched by blowing to wall thicknesses of about 10 to 40 $\mu$.

Especially suitable are so-called co-extrudates, whereby two films are extruded lying next to one another. There is hereby preferred a combination of low pressure and high pressure polyethylene. However, composite materials, such as polyethylene with polypropylene, can also be used.

The stability of the bottle can be further increased by bringing together of the ellipsoid halves to give a complete V-seam. This can be co-formed but it is also possible to weld the halves with one another.

Since the chosen material is not sufficiently inherently stable in order mechanically easily to carry labels, it is suggested to bond these with the bottle outer surface in known manner in the in-mould process in the mould.

The bottle preferably has a screw closure, whereby the threaded part is co-formed on the bottle neck in the same working step as the shaping.

In principle, it is possible to provide the bottles with recessed grips. However, these are to be so shaped that they do not hinder the procedure of the folding up.

Therefore, it is, furthermore, suggested to structure the bottle or the recessed grips, especially to provide with a knub.

In the case of the folding up by hand or by pressure exerted by other waste, the screwing represents a resistance which cannot be overcome, especially by neighbouring waste. Therefore, it is necessary to remove the screw cap before discarding, as well as in the case of folding up in order to make possible the emergence of air.

In order also to make the thread itself foldable, it is suggested to provide this with incisions, whereby, in particular, a fillet weld is to be produced with which are associated two straight incisions staggered by e.g. 90°. In the case of folding up of the threaded part, the fillet weld halves lie on one another, whereas the incisions are spread out.

Finally, it is also suggested to provide the outer surfaces with buckling lines which act as strengthening and, at the same time, make possible a corresponding shaping.

The present invention is explained in more detail by way of example on the basis of the accompanying Figures.

Figure 1:
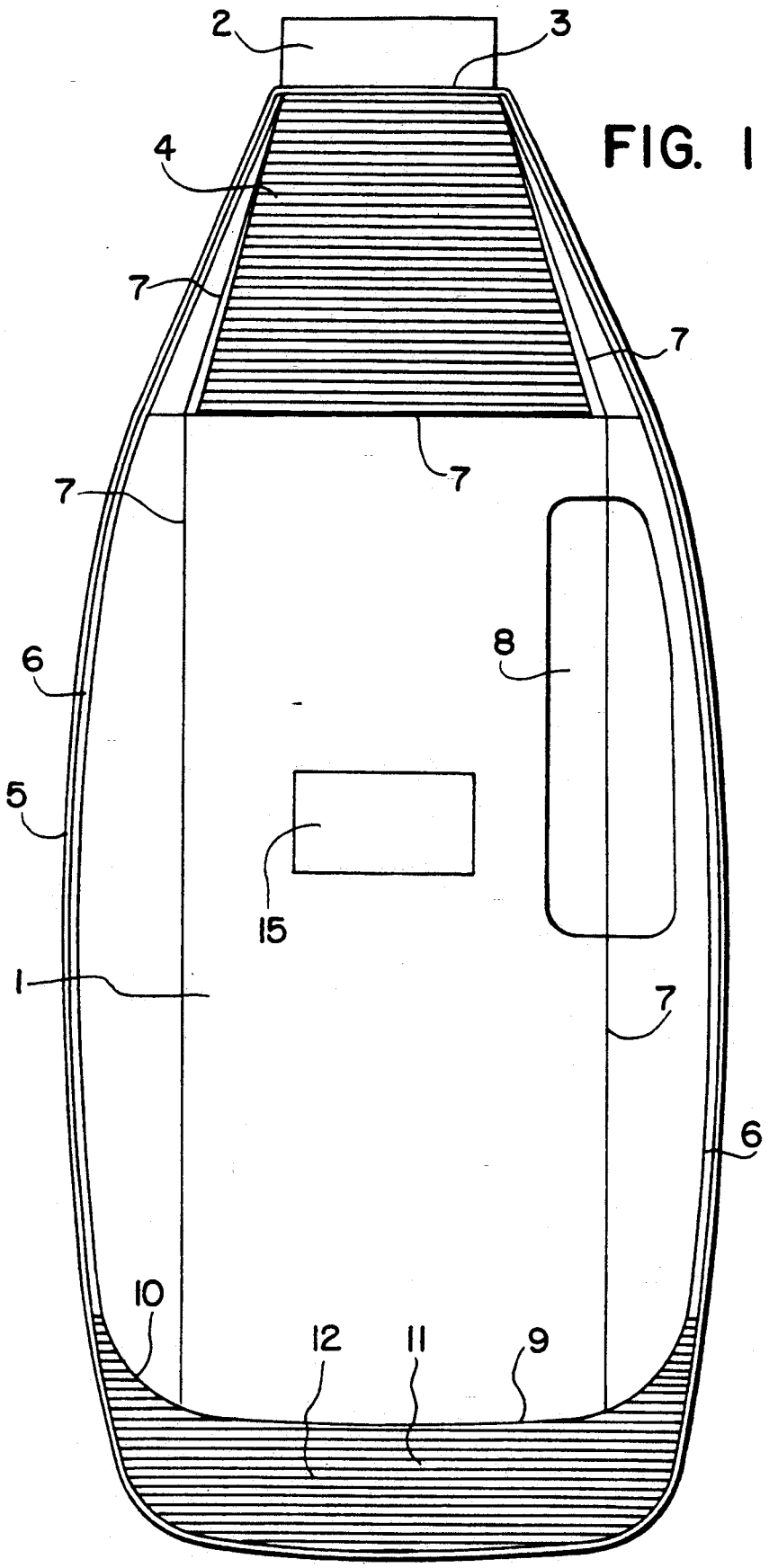
FIG. 1 shows a storage bottle according to the invention in side view.

FIG. 1 shows a bottle half in side view with its outer surface 1. Above, there is present the neck as filling opening 2 with the annular groove 3. The bottle upper part can be provided with a stiffening ribbing 4.

Parallel to the outer circumferential edge 5 is shown a beading 6 which simplifies the folding up of the bottle halves and, due to the distance to the edge 5, brings about a buckling which firmly holds the folded bottle halves. Towards the middle line, inwardly displaced, are shown buckling lines 7 which stiffen the bottle halves. On the right-hand bottle edge is shown a recessed grip 8. This can be provided with or replaced by co-formed knobs.

The bottom is formed by the standing edges 9 which run via the curvature 10 or via corners into the beadings 6. The standing edges are preferably stiffened by shaping, especially buckled inwardly. On the standing edge 9 is connected the limp bottom surface 11 which is here provided with a corrugation 12.

The bottle is here shown in the upright state, i.e. the bottom surface hangs downwardly sack-like. Moreover, a label 15 is schematically shown on the bottle.

Figure 2:
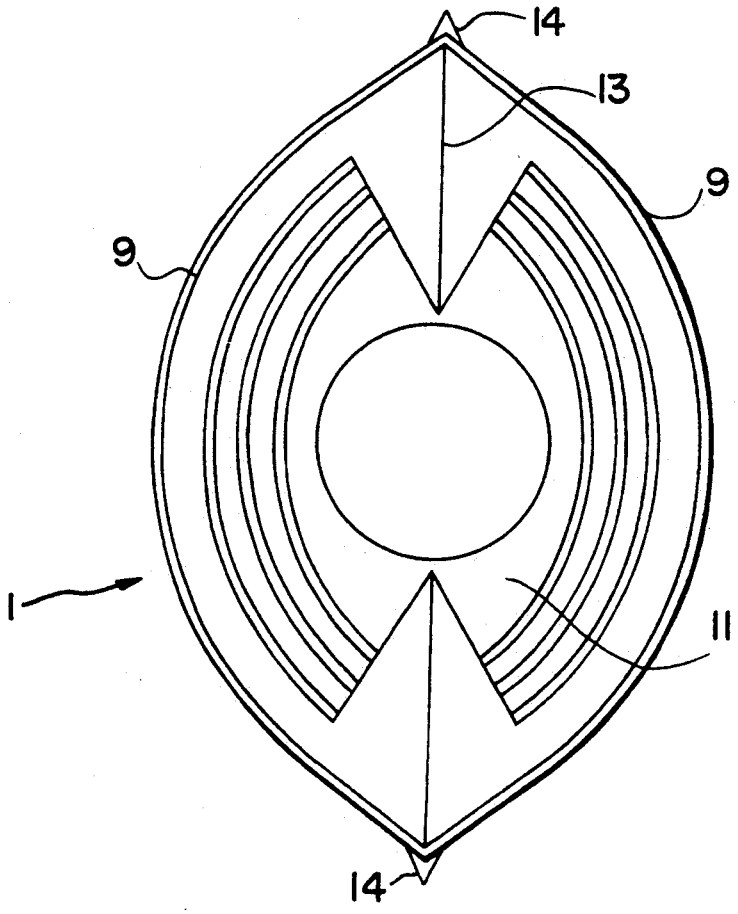
FIG. 2 shows a bottom view.

FIG. 2 shows the bottle bottom from below. One sees the standing edges 9 on which is connected inwardly the corrugation 12 of the bottom surface 11. Along the line 13 is welded the synthetic material tube extruded before the forming. The outer surfaces connected to the standing edges (FIG. 1) here pass over into angularly running V-seams 14 which increase the shape stability.

We claim:

1. A collapsible storage bottle for household liquids, comprising:

a pair of outer surfaces which define an ellipsoidal shape in a horizontal cross-section;

a corrugated bottom surface having a wall thickness sufficient to make it flexible and movable between inwardly and outwardly bent positions;

a head end having a closeable filling opening therein; and horizontal standing edges connecting said pair of outer surfaces to said bottom surface, said inwardly and outwardly bent positions being determined relative to said horizontal standing edges;

wherein the storage bottle is made from a synthetic material and stands stably in an unfilled state, and the bottom surface conforms to a surface upon which it is placed and said bottle includes means for folding such that walls respectively defining each of the outer surfaces lay substantially flat against each other.

2. A storage bottle as recited in claim 1, wherein at least one of said pair of outer surfaces has an edge region and a beading, and said beading extends in said edge region from said fill opening in said horizontal standing edges.

3. A storage bottle as recited in claim 1, wherein the storage bottle is a co-extruded bottle.

4. A collapsible storage bottle for household liquids, comprising:

a pair of outer surfaces which define an ellipsoidal shape in a horizontal cross-section;

a corrugated bottom surface having a wall thickness sufficient to make it flexible and movable between inwardly and outwardly bent positions;

a head end having a closeable filling opening therein; and horizontal standing edges connecting said pair of outer surfaces to said bottom surface, said inwardly and outwardly bent positions being determined relative to said horizontal standing edges;

wherein the storage bottle is made from co-extruded low pressure and high pressure polyethylene and stands stably in an unfilled state, and the bottom surface conforms to a surface upon which it is placed and said bottle include means for folding such that walls respectively defining each of the outer surfaces lay substantially flat against each other.

5. A collapsible storage bottle for household liquids, comprising:

a pair of outer surfaces which define an ellipsoidal shape in a horizontal cross-section;

a corrugated bottom surface having a wall thickness sufficient to make it flexible and movable between inwardly and outwardly bent positions;

a head end having a closeable filling opening therein; and horizontal standing edges connecting said pair of outer surfaces to said bottom surface, said inwardly and outwardly bent positions being determined relative to said horizontal standing edges;

wherein the storage bottle is made from a synthetic material film having a thickness of approximately 10–30 $\mu$ and stands stably in an unfilled state, and the bottom surface conforms to a surface upon which it is placed and said bottle is foldable such that walls respectively defining each of the outer surfaces lay substantially flat against each other.

6. A collapsible storage bottle for household liquids, comprising:

a pair of outer surfaces which define an ellipsoidal shape in a horizontal cross-section;

a corrugated bottom surface having a wall thickness sufficient to make it flexible and movable between inwardly and outwardly bent positions;

a pair of V-seams connecting said pair of outer surfaces and extending to said bottom surface;

a head end having a closeable filling opening therein; and horizontal standing edges connecting said pair of outer surfaces to said bottom surface, said inwardly and outwardly bent positions being determined relative to said horizontal standing edges;

wherein the storage bottle is made from a synthetic material having a thickness of approximately 10–30 $\mu$ and stands stably in an unfilled state, and the bottom surface conforms to a surface upon which it is placed and said bottle is foldable such that walls respectively defining each of the outer surfaces lay substantially flat against each other.

7. A collapsible storage bottle for household liquids, comprising:

a pair of outer surfaces which define an ellipsoidal shape in a horizontal cross-section;

a corrugated bottom surface having a wall thickness sufficient to make it flexible and movable between inwardly and outwardly bent positions;

a head end having a closeable filling opening therein; and horizontal standing edges connecting said pair of outer surfaces to said bottom surface, said inwardly and outwardly bent positions being determined relative to said horizontal standing edges;

a label mounted on the storage bottle during an in-mould process;

wherein the storage bottle is made from a synthetic material and stands stably in an unfilled state, and the bottom surface conforms to a surface upon which it is placed and said bottle includes means for folding such that walls respectively defining each of the outer surfaces lay substantially flat against each other.

8. A collapsible storage bottle for household liquids, comprising:

a pair of outer surfaces which define an ellipsoidal shape in a horizontal cross-section;

a corrugated bottom surface having a wall thickness sufficient to make it flexible and movable between inwardly and outwardly bent positions;

a head end having a closeable filling opening therein; and horizontal standing edges connecting said pair of outer surfaces to said bottom surface, said inwardly and outwardly bent positions being determined relative to said horizontal standing edges;

a screw closure having a ring groove on a lower end thereof for engagement with corresponding prongs of a filling plant;

wherein the storage bottle is made from a synthetic material and stands stably in an unfilled state, and the bottom surface conforms to a surface upon which it is placed and said bottle includes means for folding such that walls respectively defining each of the outer surfaces lay substantially flat against each other.

* * * * *